US007220186B1

(12) United States Patent
Burnham

(10) Patent No.: US 7,220,186 B1
(45) Date of Patent: May 22, 2007

(54) BOWLING BALL INSERT PROVIDING FINGER TIP GRIPPING

(76) Inventor: Steven M. Burnham, 6015 Calle Paraiso St., Las Cruces, NM (US) 88012

( * ) Notice: Subject to any disclaimer, the term of this patent is extended or adjusted under 35 U.S.C. 154(b) by 13 days.

(21) Appl. No.: 11/035,871

(22) Filed: Jan. 10, 2005

Related U.S. Application Data

(63) Continuation-in-part of application No. 29/176,416, filed on Feb. 24, 2003, now abandoned.

(51) Int. Cl.
*A63B 43/02* (2006.01)

(52) U.S. Cl. ..... 473/128

(58) Field of Classification Search ..... 473/125, 473/127, 128, 130
See application file for complete search history.

(56) References Cited

U.S. PATENT DOCUMENTS 3,425,133 A * 2/1969 Smith ..... 33/510
3,538,515 A * 11/1970 Brown ..... 623/65
4,381,863 A * 5/1983 Norman ..... 473/130
5,176,378 A * 1/1993 Bernhardt ..... 473/128
5,972,009 A * 10/1999 Fortier et al. ..... 606/157

* cited by examiner

*Primary Examiner*—William M. Pierce
(74) *Attorney, Agent, or Firm*—Mark Clodfelter

(57) ABSTRACT

A finger grip system is provided for obtaining maximum rotation and a resulting pronounced hook when releasing a bowling ball. The system includes drilled holes for receiving a bowler's middle finger, ring finger and thumb, the holes being spaced such that only fingertips may be inserted into the holes. Inserts are placed in the holes, the inserts having a resilient frictional character, and defined therein lips at the corner of a bottom surface and a wall of a central aperture. The inserts are sized to locate the lips such that dominant upward force applied by the fingers and thumb results from contact of finger and thumb tips rather than other parts of the fingers. Force applied in this manner results in increased rotation of bowling balls.

6 Claims, 2 Drawing Sheets

BOWLING BALL INSERT PROVIDING FINGER TIP GRIPPING

CROSS REFERENCE TO RELATED APPLICATION

This application is a continuation-in-part of application Ser. No. 29/176,416 filed by applicant on Feb. 24, 2003 now abandoned.

FIELD OF THE INVENTION

This invention relates to bowling balls, and more particularly to positioning of finger holes, thumb holes and inserts placed in the holes.

BACKGROUND OF THE INVENTION

Bowling balls are provided with holes, as by drilling into the bowling ball, the holes serving as finger and thumb grips for a bowler to hold and throw the ball down an alley at bowling pins. These holes, for a conventional bowling ball, include holes for receiving the thumb, middle finger and ring finger of a bowler. Holes in a bowling ball are sized to provide a comfortable fit with fingers of a bowler. The holes are also spaced apart at a distance appropriate the spread of the bowler's fingers. This spread is determined by distances between the base of a bowler's thumb and the proximal interphalangeal joint (the joint nearest the palm) of the middle and ring finger of the user of the bowling ball. Uniformly throughout the prior art, the bowler inserts his thumb into the ball up to the base of the thumb and fingers into the ball up to the proximal interphalangeal joint. As such, a thumb hole is typically three inches or more in depth, and the finger holes are typically two inches or more in depth.

In order to knock down as many pins as possible, most bowlers seek to obtain a pronounced hook on the path of the ball, this type of delivery geometrically providing more rotation creating more revolutions and thereby the most pin action, or mixing of the pins after they are struck by the ball. To make the ball hook, effective contact between the fingers and the ball is necessary to deliver the ball in a manner such as to impart a lifting and twisting action on the ball, causing it to spin as it rolls down the lane.

Various finger inserts and other measures have been devised for use with bowling balls, primarily to enable an improved spin and a more effective hook. In general, the prior art insert devices have been used in combination with conventional drilled holes, which as stated typically extend to a depth of two inches or more for fingers and three inches or more for thumbs. As a result, contact of the fingers and thumb within the ball occurs the length of the fingers up to the proximal interphalangeal joint and length of the thumb within a respective finger or thumb hole so that contact with finger and thumb tips is not predominant.

SUMMARY OF THE INVENTION

The present invention is directed to a finger tip grip system for use with a bowling ball so as to maximize lift and spin to the ball as it is rolled down a bowling lane. The system includes drilled holes into the ball for receiving middle, ring finger tips and the thumb tip, and inserts placed in the holes for being contacted with the finger tips and thumb tip in releasing the ball. The finger inserts are constructed to be resilient, and they have lips defined at their inner ends, the lips being located at a distance from their outer ends such that fully inserted finger tips can reach around and engage the lips. Thus, contact between fingers and the inserts is limited to finger tips up to the distal interphalangeal joint of the finger (the joint nearest the fingertip), and up to the interphalangeal joint of the thumb (the joint nearest the end of the thumb). In addition, the drilled holes are placed at a greater span than with a conventional bowling ball so that only finger and thumb tips may be inserted into the bowling ball. By limiting finger contact with the ball to finger tips, a more pronounced upward lifting of the ball may be provided to control the ball, this lifting motion being such as to provide more spin, resulting in a more effective hook.

It is therefore an object of this invention to provide a finger grip system that allows a bowler to exert greater lifting force than has hitherto been possible in releasing the ball.

Another object is to obtain a more effective hook, resulting in more revolutions imparted on the bowling ball thus maximizing pin action.

DESCRIPTION OF THE PREFERRED EMBODIMENT

Figure 1:
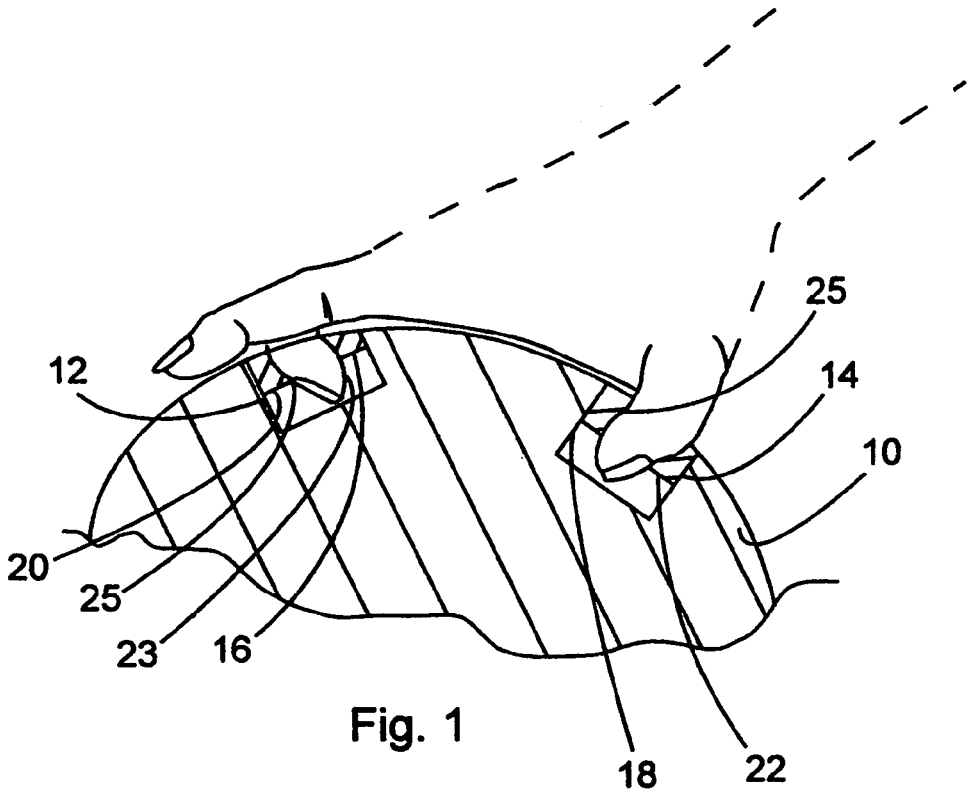
FIG. 1 is a cut-away view showing a bowler's finger tips and thumb tip placed in position in an insert.

Referring to FIG. 1 of the drawings, there is shown a bowling ball 10 having drilled holes 12 and 14, each of the holes receiving an insert 16, 18. The inserts each have a lip 20, 22 defined by a bottom 25 of the insert and a central aperture 23 through which a finger or thumb is inserted. Most importantly, it is noted that both the drilled holes and the inserts are much more shallow than prior inserts and holes known to applicant in the prior art so that only a fingertip is accommodated within a respective hole. In addition, spacing between the finger holes and a thumb hole is such so that only finger tips up to the distal interphalangeal joint and a thumb tip up to the interphalangeal joint may be inserted into the bowling ball. This configuration keeps the bowler from applying significant force by other than finger tips and rotation of the ball.

Structure of this insert enables bowlers to actually to feel, through their fingertips, the proper way of achieving maximum lift at release by reaching a maximum spin rate for their ability. Positioning the finger below and in contact with the lip of the insert gives the bowler a true lifting edge, assuring a correct release of the ball and increasing the chances of obtaining best possible results. In addition, the increased distance of the span between finger tips and thumb tips allows a bowler to provide additional leverage to the ball that is not available with the conventionally placed holes of the prior art.

Other aspects of using an insert may be handled in ways similar to prior inserts. The top of the insert is required by ABC rules to be flush with the bowling ball surface, and this rule is followed for the inserts of the instant invention. While the inner diameter of the insert may be varied in size based on the bowler's actual finger and thumb size, the outer diameter may be nominally 31/32 inches of 7/8 inches in diameter, although larger sizes are possible for bowlers with larger fingers. Typically, lips 20, 22 (FIG. 1) are at least 1/8 inches up to about 1/4 inches or so wide, although as stated other opening, lip and outside diameter sizes may be provided where necessary. Thickness or height of the insert is a minimum of about 1/2 inch, up to a maximum of about one inch or so, depending on a length of the user's finger tips up to the distal interphalangeal joint and thumb tip up to the interphalangeal joint. Significantly, as shown in FIG. 1, the lip should be engaged at generally a middle of a bowler's finger tip to provide maximum lift and leverage to the ball.

Figure 2:
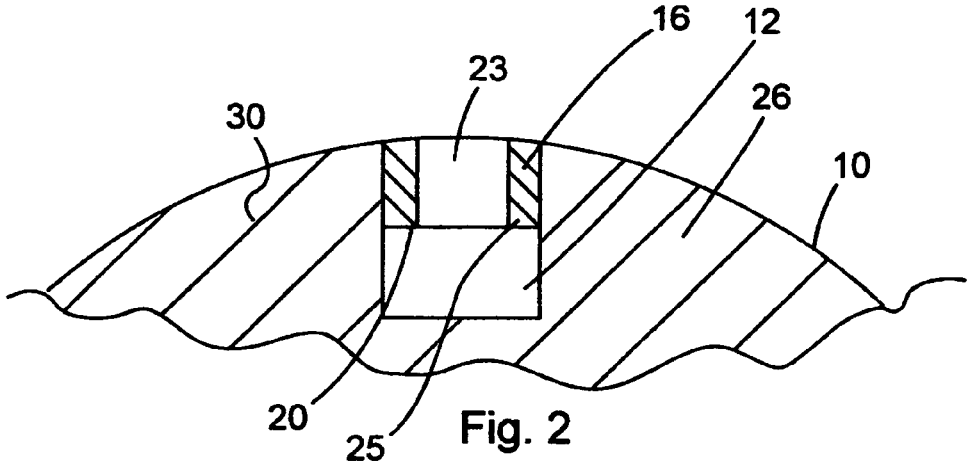
FIG. 2 is a cut away-view of one embodiment of an insert glued or bonded to an interior of a hole drilled in a bowling ball.

FIG. 2 shows one embodiment of an insert wherein the insert is mounted with an upper surface thereof being flush with and curved in accordance with a surface of the ball. As shown, the insert extends approximately halfway into opening 12 of the ball, the opening 12 being about 1 inch or so deep to accommodate a fingertip extending beyond lip 20 of insert 16.

Figure 3:
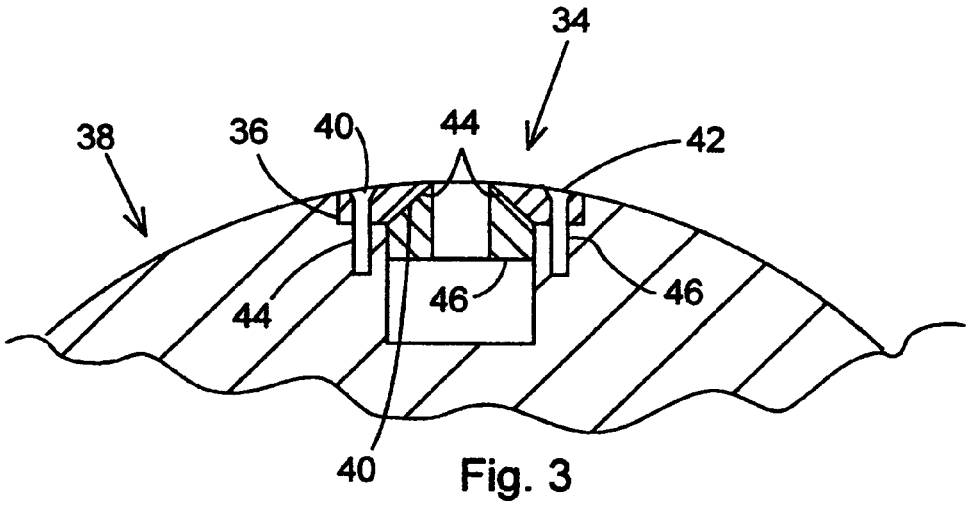
FIG. 3 is a cut-away view of another embodiment of an insert, the insert including a retaining member recessed into the ball and flush with a surface of the ball.

FIG. 3 shows another embodiment of an insert wherein an insert 34 is held in position by a hard ring 36 connected to the bowling ball 38 by means of screws or other fasteners 40, 42 extending through openings in ring 36 and engaging threaded openings 44, 46 within bowling ball 38. As shown, ring 36 is recessed into the bowling ball and fabricated of a hard material similar to the surface of a bowling ball so as to provide a contiguous surface in both hardness and curvature of the bowling ball. Likewise, screws or other fasteners 40, 42 are recessed into the surface of the ball, and may be covered by smoothed epoxy or other material so as to be contiguous with the surface of the ball. In addition, and by way of example, ring 36 overlaps a resilient portion 46 such as described above to securely hold resilient portion 46 in place, as by a mating angular interface 44 between resilient portion 46 and ring 36. This embodiment is advantageous in that the insert may be removed and replaced when the resilient portion becomes worn or otherwise unsuitable for play, or when the inserts are to be preserved where the ball becomes worn or unsuitable for play.

Figure 4:
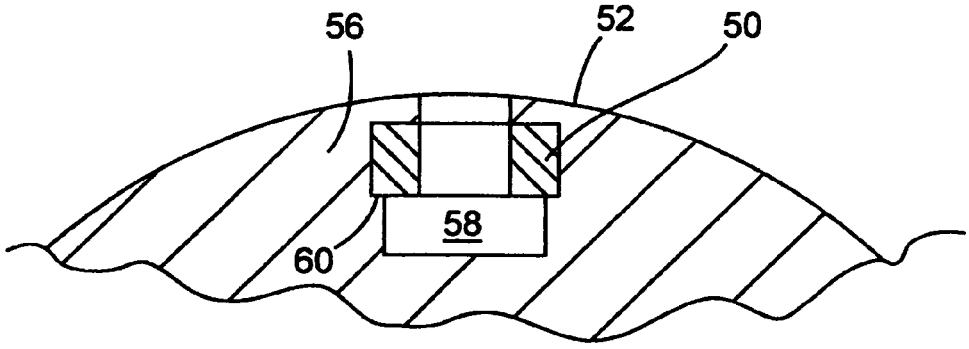
FIG. 4 is a cut-away view through an insert illustrating how an insert may be bowling ball.

FIG. 4 shows an embodiment wherein an insert 50 is secured in place by an overlapping region 52 of the bowling ball 56. Such an overlapping region may be formed by recessing insert 50 slightly within the bowling ball to a depth of perhaps 1/8 inch or so and covering the insert with a layer of epoxy or other self-hardening material that may be conventionally smoothed so as to be contiguous with the surface of the bowling ball. Alternately, this embodiment may be made removable by threading interfacing surfaces between region 52 and the bowling ball so that the insert is provided with a hard outer portion that may be threadably engaged with an opening within which the insert is fitted. In addition, and as one feature of the instant invention, opening 58 within which finger and thumb tips extend into is shown as being slightly smaller in diameter than a diameter of an opening within which insert 50 is fitted so as to provide a step 60. With this construction, the resilient insert 50 is securely held in place between regions 52 and step 60. Such a step 60 may also applied to the embodiments of FIGS. 2 and 3 where necessary.

While the invention is described above in terms of specific embodiments, it is not to be understood as limited to those embodiments, but is limited only as indicated by the appended claims. Various changes and modifications may be made by one skilled in the art without departing from the spirit and scope of the invention as defined in the following claims, wherein I claim.

I claim:

1. A fingertip grip system for enabling release of a bowling ball in a manner maximizing lift and spin of the ball comprising:

a bowling ball having finger holes and a thumb hole of a spacing such that only a middle finger tip, a ring finger tip and a thumb, respectively, of a bowler may be inserted into said finger holes and said thumb hole up to about a first interphalangeal joint, a circular insert mounted in an upper region of each of said finger holes, each said insert having an upper surface and lower surface, each said circular insert further having a central opening therein for receiving a respective one of said tips of said middle finger and said ring finger, said central opening being slightly larger than a respective one of said tips of said middle finger and said ring finger of a bowler, each said insert configured with a thickness such that an end of said middle finger tip and said ring finger tip extend completely past said insert and into a respective said hole, said upper surface of each said insert being proximate a surface of said bowling ball and each said lower surface of each said insert positioned about halfway into a respective one of said finger holes and defining a single, inner lip inside a respective one of said finger holes, each said lip positioned to engage a middle region of a respective one of said tips of said middle finger and said ring finger so that said finger tips provide a dominant upward force in releasing said ball, whereby increased lift and spin of said bowling ball are obtained and a bowler feels through said fingertips a proper way to achieve said increased lift and spin of said bowling ball.

2. A grip system as set forth in claim 1 wherein each said insert is of a resilient material.

3. A grip system as set forth in claim 2 wherein diameter of each of said finger holes is drilled to accommodate a respective said insert so that said single, inner lip is from about 1/8 of an inch to about 1/4 of an inch in width.

4. A system as set forth in claim 3 further comprising a retaining member larger in diameter than said insert and having a central opening therein coaxial with said central opening in said insert, said retaining member recessed into said bowling ball and having an upper surface flush with a surface of said bowling ball and having a lower surface bearing against said upper surface of said insert, thereby holding said insert in place in said opening.

5. A system as set forth in claim 4 wherein said retaining member is held place by fasteners extending through outer regions of said retaining member and into said bowling ball, with an outer end of said fasteners recessed into said insert.

6. A system as set forth in claim 4 wherein said retaining member is constructed contiguous with said bowling ball.

* * * * *